US011278089B2

(12) United States Patent
Ahmed

(10) Patent No.: US 11,278,089 B2
(45) Date of Patent: Mar. 22, 2022

(54) ADJUSTABLE AND WEARABLE UMBRELLA HOLDER

(71) Applicant: Humeira Syed Basheer Ahmed, Walnut Creek, CA (US)

(72) Inventor: Humeira Syed Basheer Ahmed, Walnut Creek, CA (US)

( * ) Notice: Subject to any disclaimer, the term of this patent is extended or adjusted under 35 U.S.C. 154(b) by 0 days.

(21) Appl. No.: 17/103,746

(22) Filed: Nov. 24, 2020

(65) Prior Publication Data

US 2021/0169186 A1 Jun. 10, 2021

Related U.S. Application Data

(60) Provisional application No. 62/943,952, filed on Dec. 5, 2019.

(51) Int. Cl.
*A45B 11/02* (2006.01)
*A45F 5/00* (2006.01)

(52) U.S. Cl.
CPC ..... *A45B 11/02* (2013.01); *A45F 5/00* (2013.01)

(58) Field of Classification Search
CPC . A45B 11/02; A45B 11/00; A45B 2200/1009; Y10S 224/915; A45F 2003/025; A45F 2200/0566; A45F 3/14; A45F 2003/142; A45F 2003/146; F16M 3/04
USPC ..... 224/186
See application file for complete search history.

(56) References Cited

U.S. PATENT DOCUMENTS

| | | | | |
|---|---|---|---|---|
| 191,782 A * | 6/1877 | Smith, Sr. | A45B 11/02 224/190 |
| 2,610,778 A * | 9/1952 | Young | A45B 11/02 224/188 |
| 5,513,786 A * | 5/1996 | Drane | A45B 11/02 224/188 |
| 5,918,612 A * | 7/1999 | Hughes | A45B 11/02 135/16 |
| 7,275,668 B1 * | 10/2007 | Carroll | A45B 11/02 135/16 |
| 8,132,582 B2 * | 3/2012 | Goebel | A45B 11/02 135/16 |

* cited by examiner

*Primary Examiner* — Adam J Waggenspack
(74) *Attorney, Agent, or Firm* — Plager Schack LLP; Mark H. Plager; Kara Verryt

(57) ABSTRACT

An adjustable and wearable device for hands-free carrying of an umbrella having an umbrella shaft and an umbrella canopy extending from the umbrella shaft. The device may include a holder assembly designed to partially surround and contour to a user's upper torso, the holder assembly being a curved and contoured elongate strap body having a first end and a second end, wherein strap body includes at least two semi-circular and curvy openings sized to accommodate the umbrella shaft; and a securing strap removably engaged with the first end and the second end of the strap body.

10 Claims, 8 Drawing Sheets

ADJUSTABLE AND WEARABLE UMBRELLA HOLDER

RELATED APPLICATION

This application claims priority to provisional patent application U.S. Ser. No. 62/943,952 filed on Dec. 5, 2019, the entire contents of which is herein incorporated by reference.

BACKGROUND

The embodiments described herein relate generally to wearable gadgets and, more particularly, to an adjustable and wearable umbrella holder designed to secure around a user's shoulder(s) and upper back.

Existing wearable umbrella holders include their own umbrella, meaning that a user cannot interchange the umbrella for other sizes, colors, or brands. Moreover, the existing devices are inconvenient, complicated, uncomfortable, do not hold the umbrella securely, and often requires a backpack to attach the device to. Another wearable umbrella is worn on the head and, while this leaves both hands free, the head umbrella does not stay securely on the head when the wind blows. The all-in-one vest and umbrella is bulky and heavy for daily public use. Back straps do not hold the umbrella securely as it wobbles with the wind and are difficult to place the umbrellas in and out of due to limited access.

Therefore, what is needed is a lightweight, adjustable, secure, functional, and comfortable wearable device that is easily and quickly engaged with or disengaged from an umbrella pole leaving both of the user's hands free, wherein the device is compatible with any personal umbrella.

SUMMARY

Some embodiments of the present disclosure include an adjustable and wearable device for hands-free carrying of an umbrella having an umbrella shaft and an umbrella canopy extending from the umbrella shaft. The device may include a holder assembly designed to partially surround, grab, and contour to a user's upper torso, the holder assembly being a semi-flexible curved and contoured elongate strap body having a first end and a second end, wherein strap body includes at least two semi-circular and curvy openings sized to accommodate the umbrella shaft; and an optional securing strap removably engaged with the first end and the second end of the strap body.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a wearable and adjustable umbrella holder and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-11, some embodiments of the invention include an adjustable and wearable device 10 for hands-free carrying of an umbrella 14 comprising an umbrella canopy 14*a* and an umbrella shaft 14*b* extending from the umbrella canopy 14*a*, the device 10 comprising a holder assembly 12 designed to partially surround, grab, and contour to a user's shoulder and back, the holder assembly 12 comprising at least two semi-circular and curvy openings 12*f* sized to accommodate the umbrella shaft 14*b*, and a securing strap removably engaged with each end of the holder assembly 12. For example, each end of the holder assembly 12 may comprise a circular orifice 12*h* that allows for the fastening and rotation of the strap 18, 22 onto the user's body, as needed.

Figure 1:
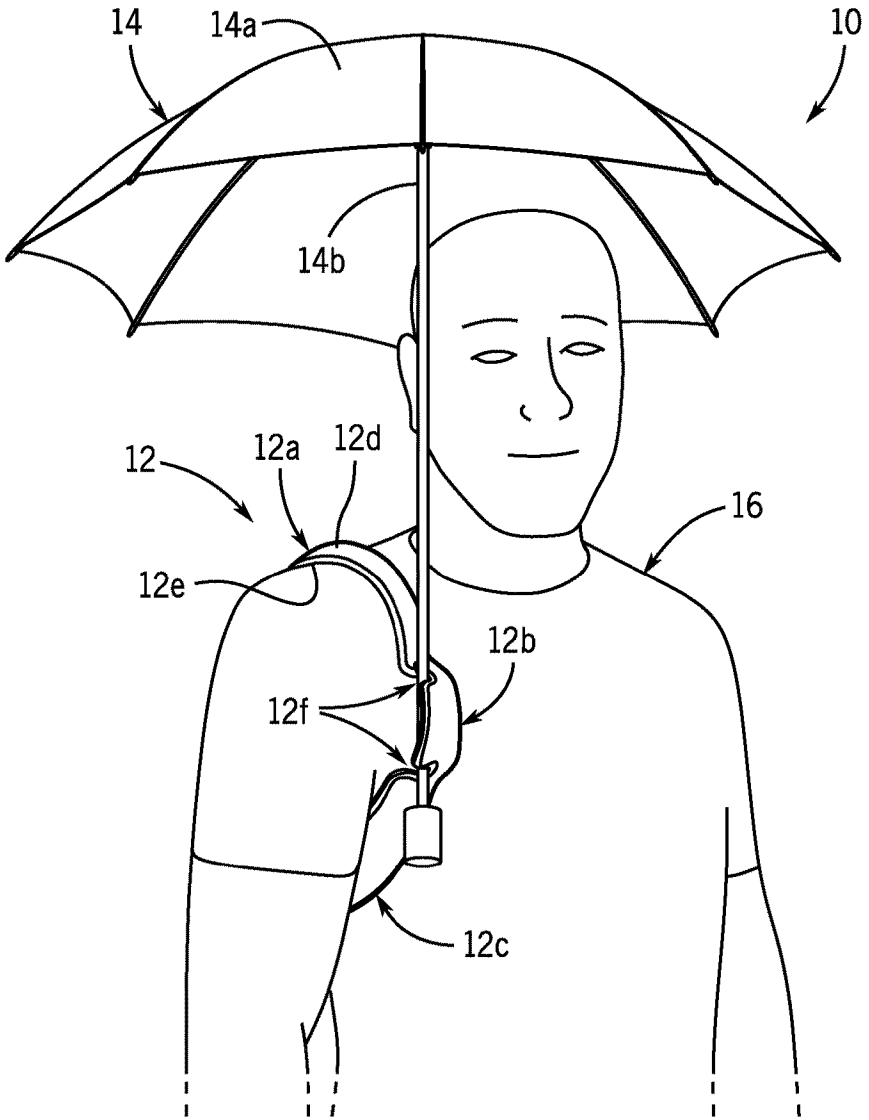
FIG. 1 is a perspective view of one embodiment of the present disclosure, shown in use.
Figure 5:
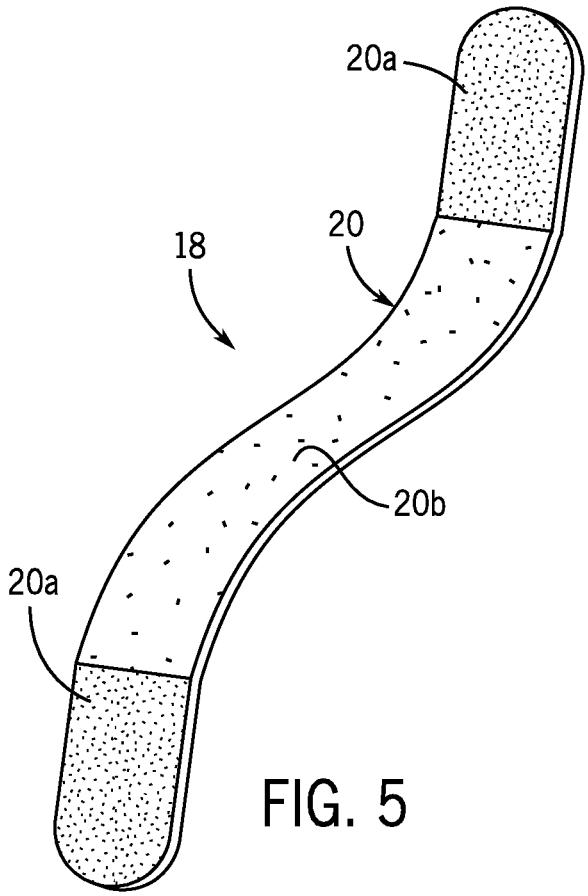
FIG. 5 is a perspective view of one embodiment of the present disclosure.
Figure 6:
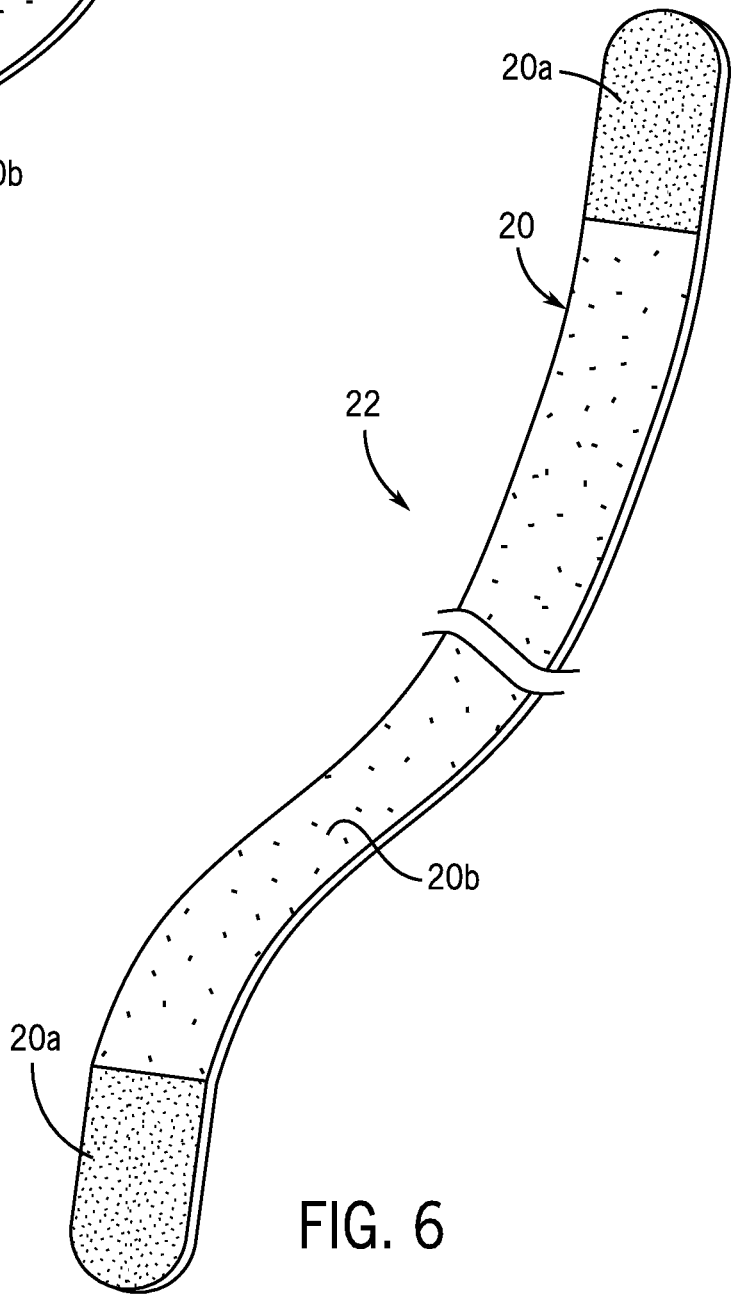
FIG. 6 is a perspective view of one embodiment of the present disclosure.
Figure 7:
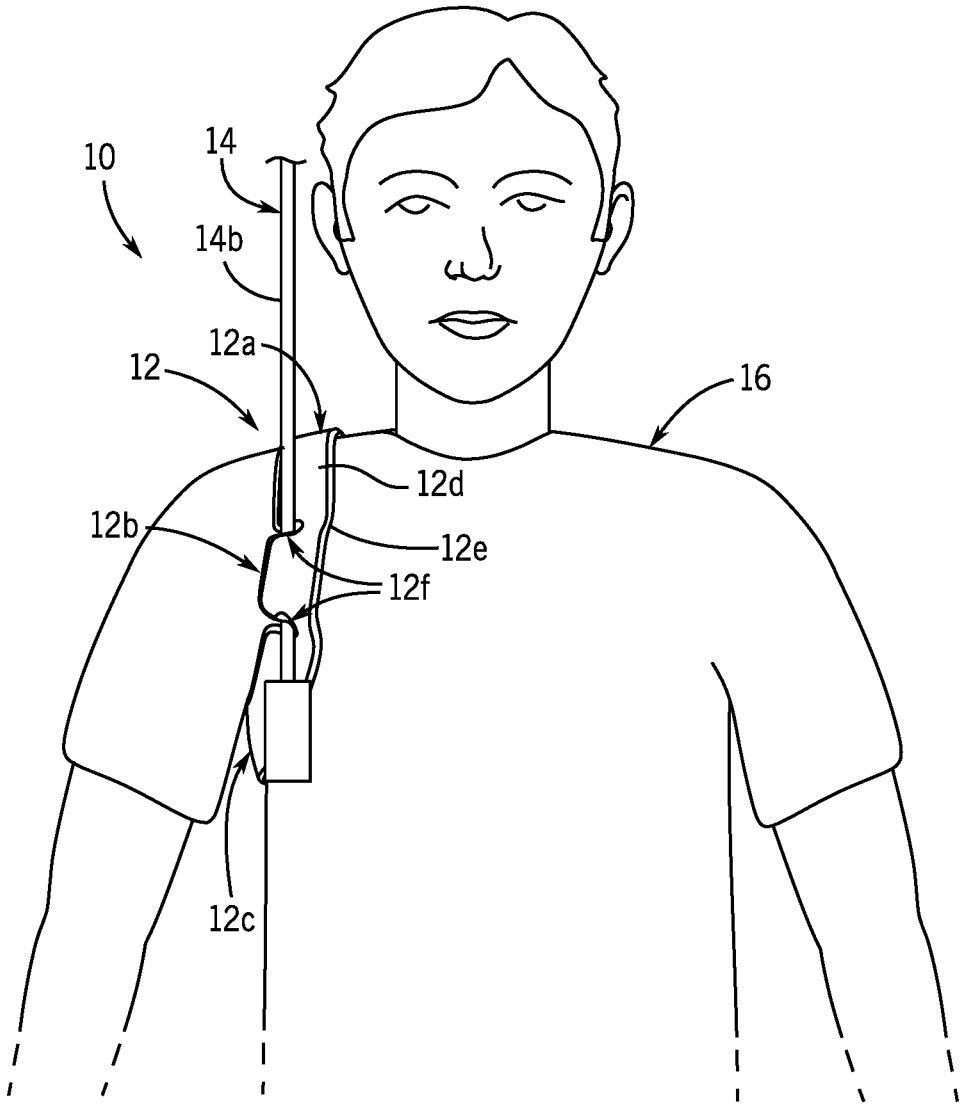
FIG. 7 is a front elevation view of one embodiment of the present disclosure, shown in use.
Figure 8:
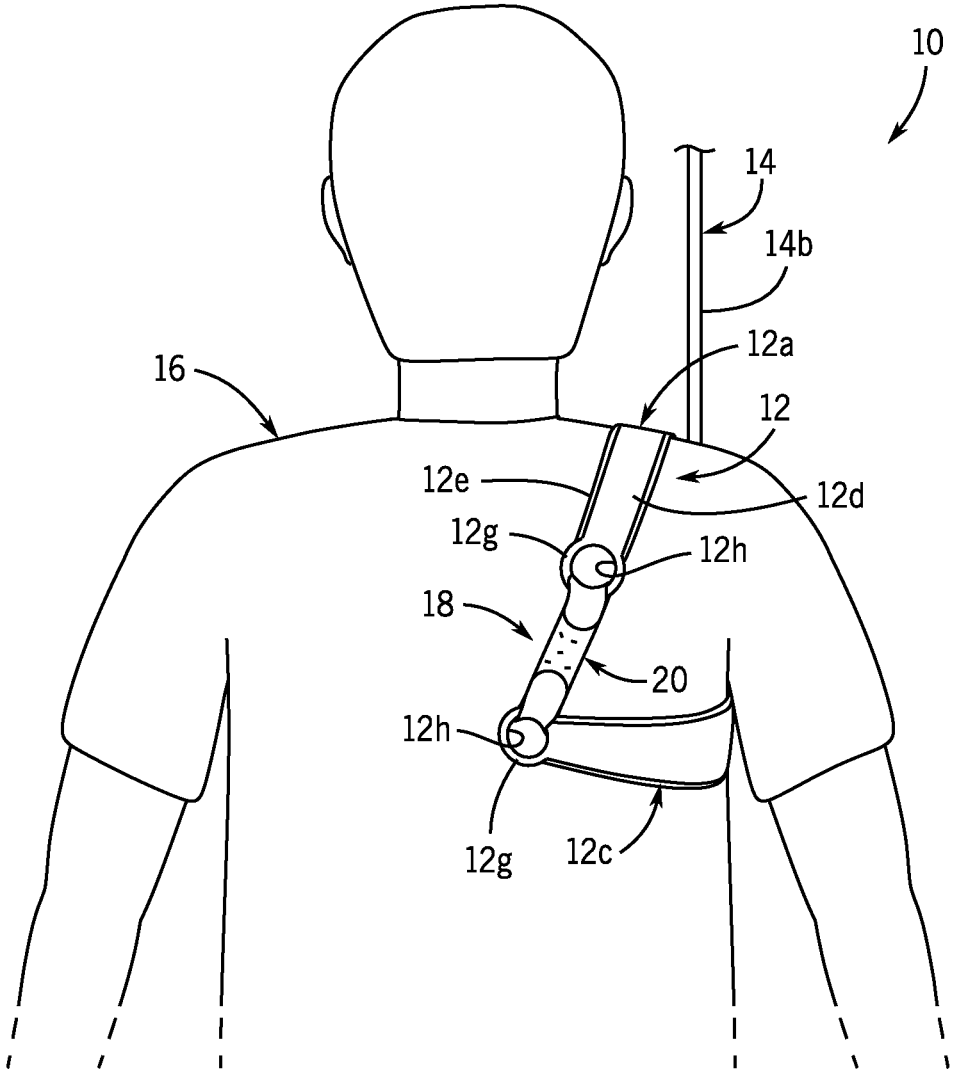
FIG. 8 is a rear elevation view of one embodiment of the present disclosure, shown in use.
Figure 9:
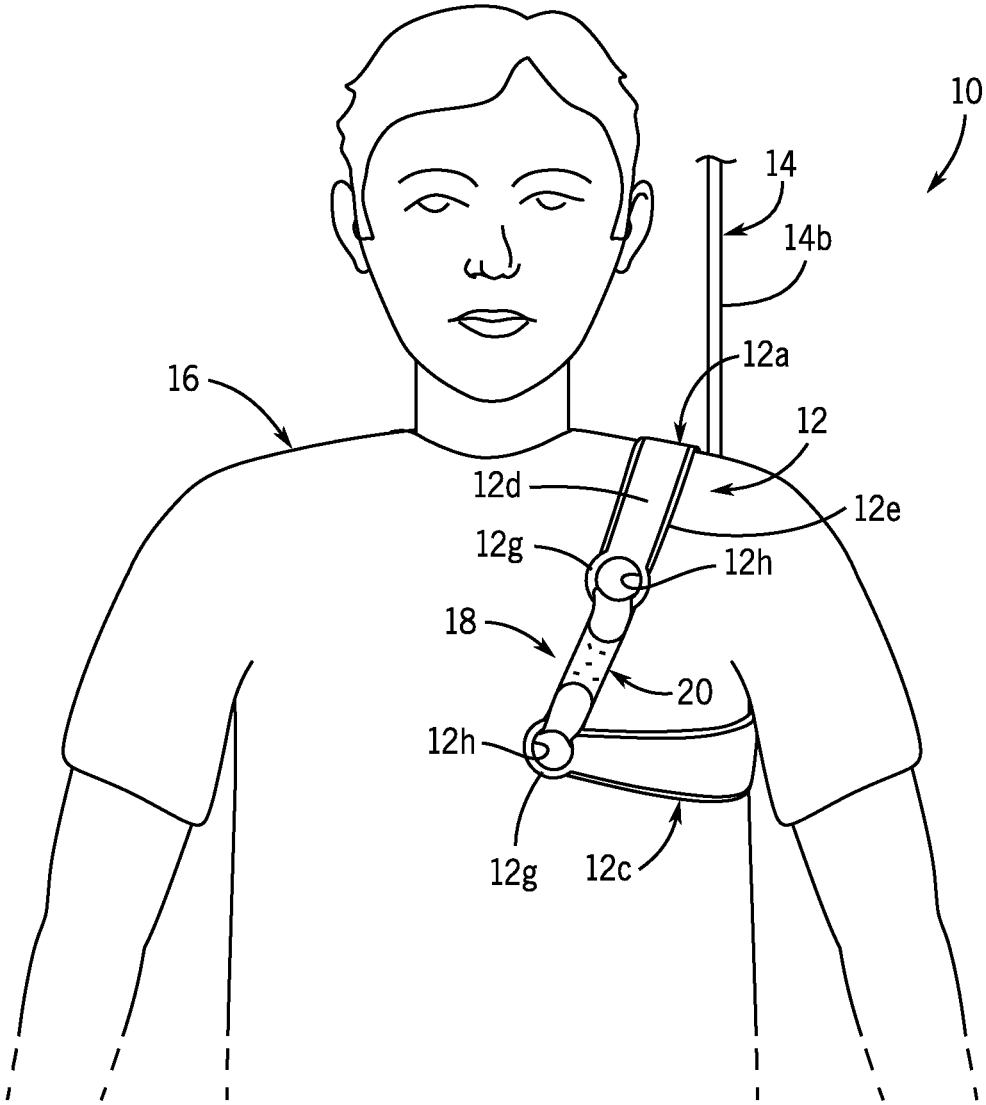
FIG. 9 is a front elevation view of one embodiment of the present disclosure, shown in use.
Figure 10:
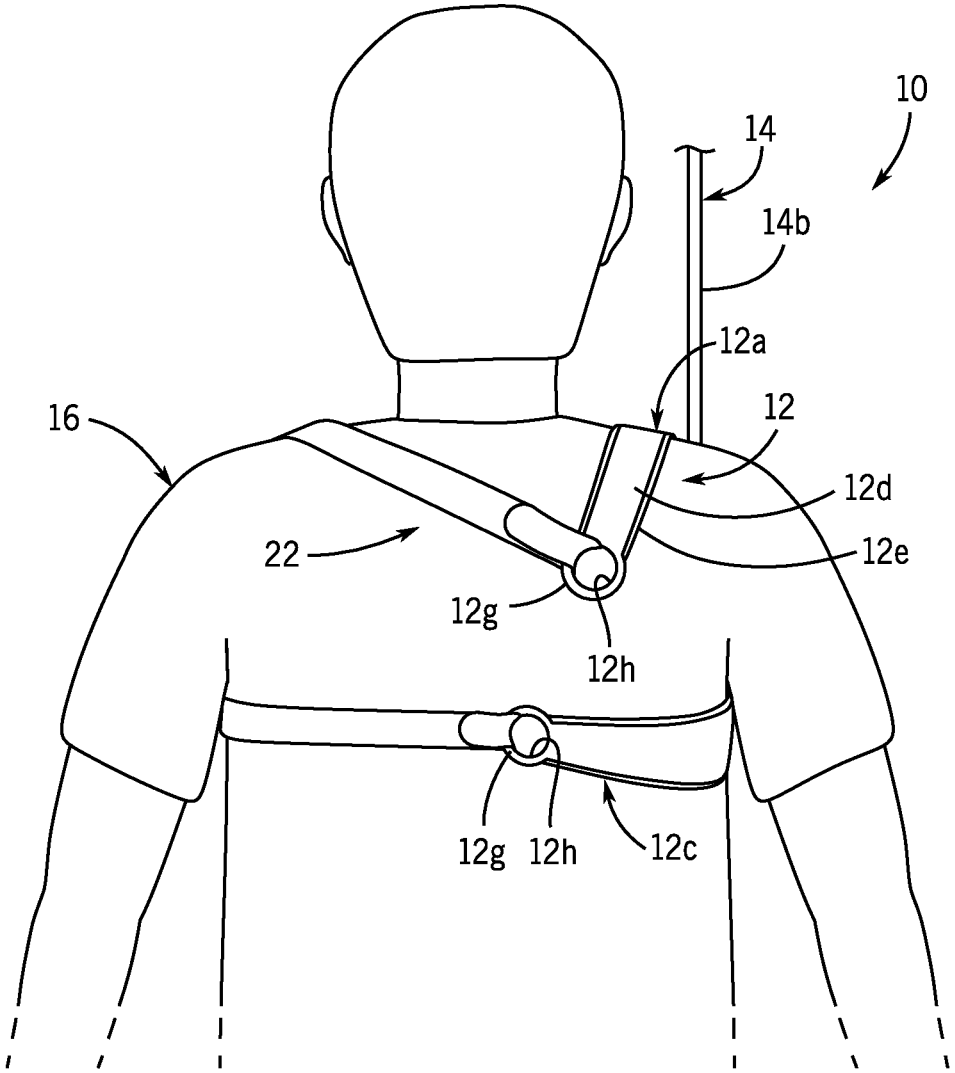
FIG. 10 is a rear elevation view of one embodiment of the present disclosure, shown in use.
Figure 11:
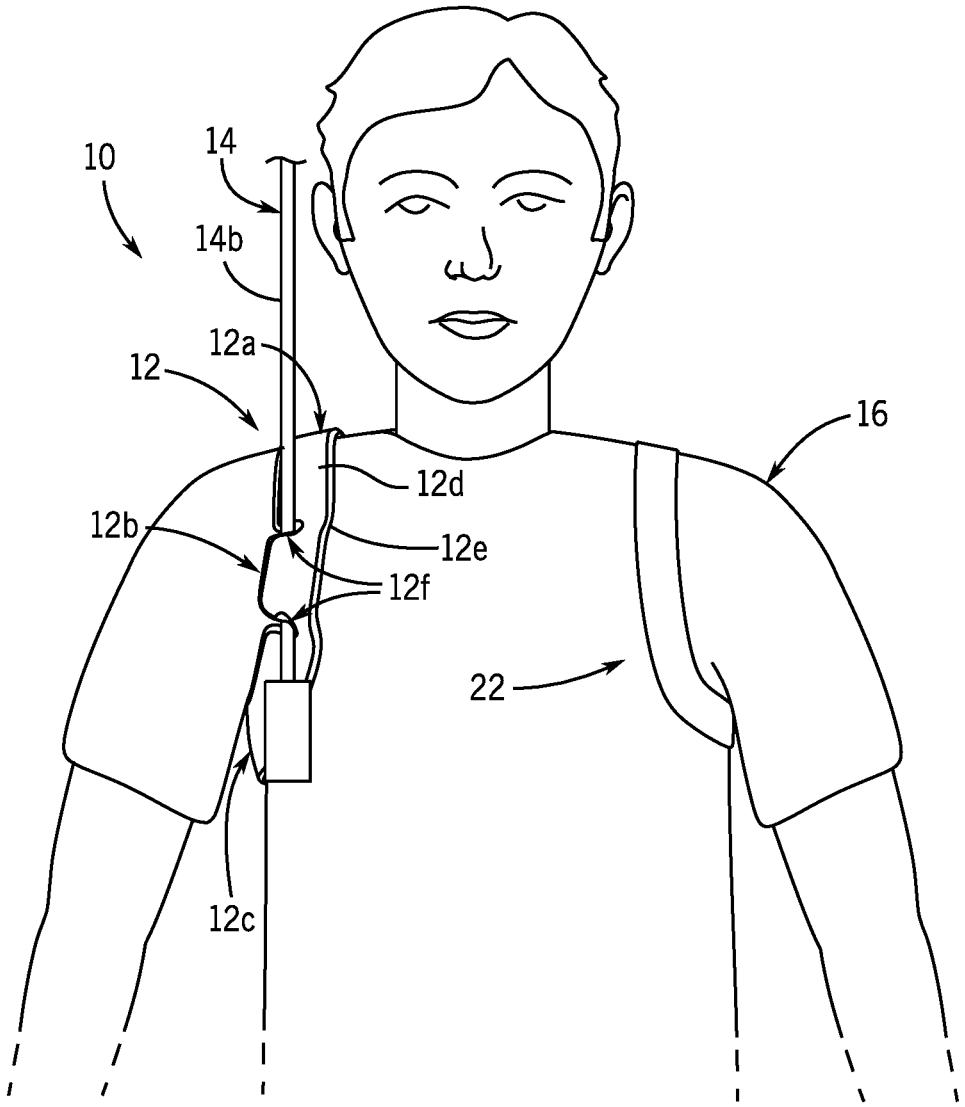
FIG. 11 is a front elevation view of one embodiment of the present disclosure, shown in use.

As shown in FIGS. 5 and 6, the securing strap may comprise, for example, a shorter securing strap 18 or a longer securing strap 22. In embodiments, the length of the strap may be dependent on the size of the user 16 or on how the user desires to wear the device 10. There may be various ways to wear the device 10. For example, as shown in FIG. 7, the holder assembly 12 may extend from an area of the back proximate to a shoulder, over the top of the shoulder, under the arm, and to a position proximate to the user's armpit and back. In embodiments, the device 10 may securely flex and grab the shoulder and back, allowing it to be used independently of the straps 18, 22. As shown in FIG. 8, the shorter securing strap 18 may secure to both end of the holder assembly 12 and extend directly down the user's back from the first end of the holder assembly 12 to the second end of the holder assembly 12. Alternatively, as shown in FIG. 10, the longer securing strap 22 may attach to a first end of the holder assembly 12 over the opposite shoulder, under the opposite armpit, and back across the user's back to the second end of the holder assembly 12. Once the device 10 is secured to the user 16, the umbrella shaft 14*b* may be inserted or slid into the semi-circular and curvy openings 12*f*, as shown in FIGS. 1, 7, and 11, resulting in the umbrella canopy 14*a* being positioned vertically above the user 16.

Figure 2:
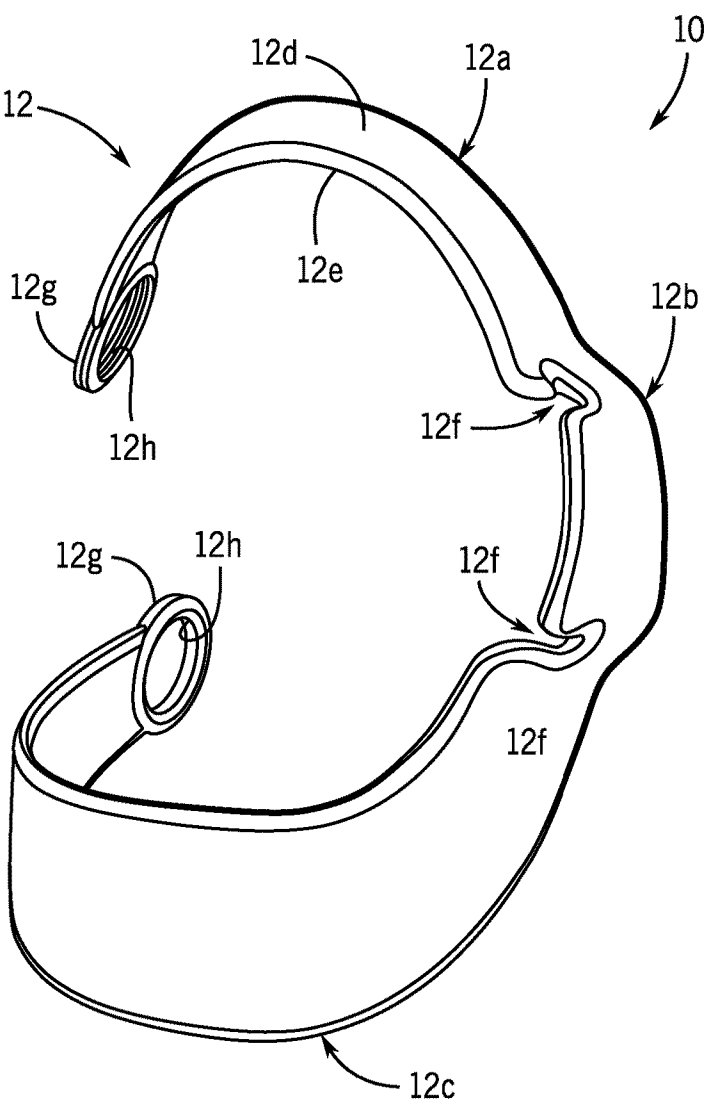
FIG. 2 is a perspective view of one embodiment of the present disclosure.
Figure 4:
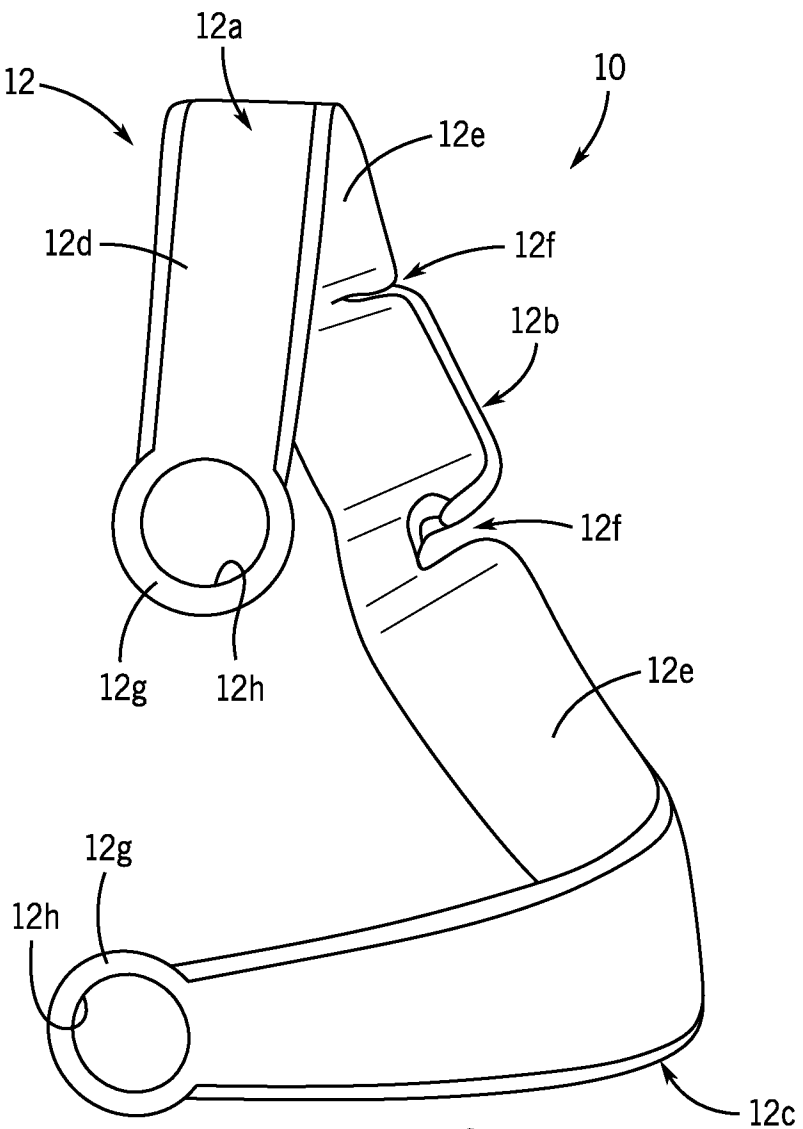
FIG. 4 is a rear elevation view of one embodiment of the present disclosure.
Figure 3:
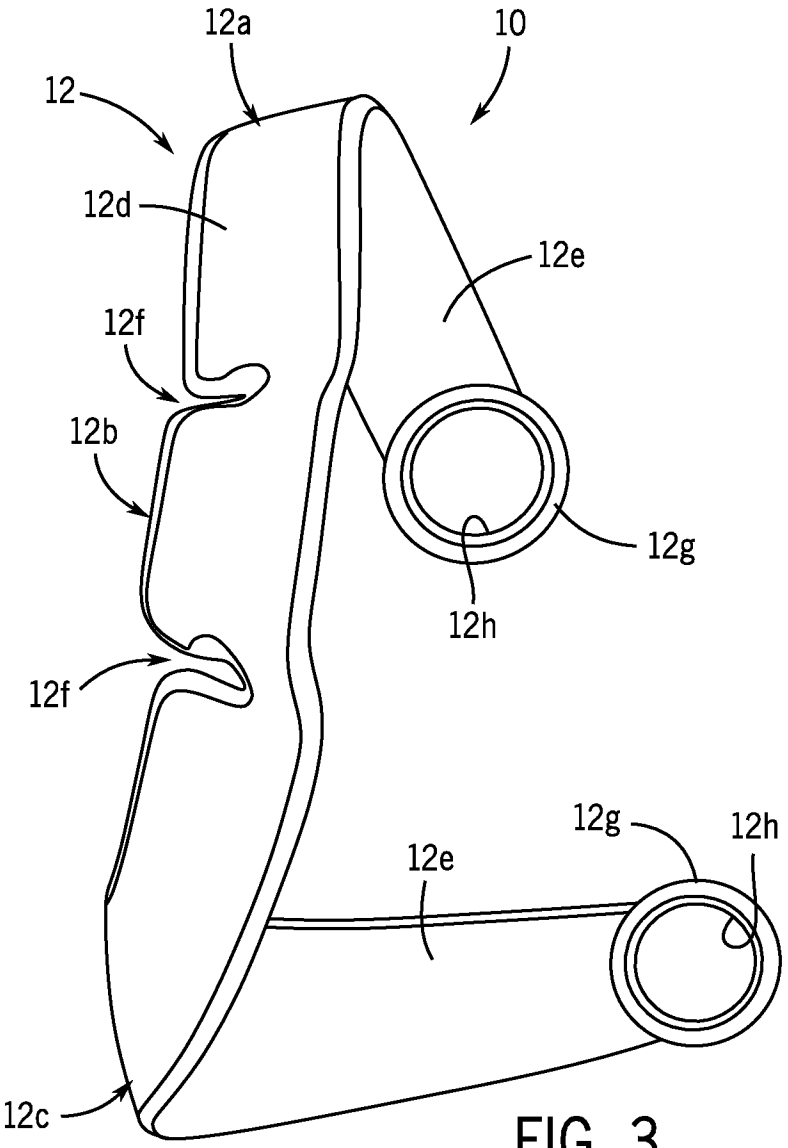
FIG. 3 is a front elevation view of one embodiment of the present disclosure.

As shown in FIGS. 2-4, the holder assembly 12 may comprise a substantially curved and contoured elongate strap body, wherein a top portion 12*a* of the strap body is designed to be positioned on the top of a user's shoulder. In a particular embodiment, the top portion 12*a* may comprise a flexible plastic material lined with a rubber material that sits on, contours, and grabs the shoulder. The user 16 may adjust the positioning of the top portion 12*a* until it sits comfortably and securely on the shoulder. A first end of the top portion 12*a* may comprise a fastening structure for removably engaging with the securing strap. For example, a first end 12*g* of the top portion 12*a* may comprise an orifice, such as a circular orifice 12*h*, extending therethrough. A second end of the top portion 12*a* may be attached to or transition into a center portion 12*b* of the strap body, wherein the center portion 12*b* may include a middle rigid plastic section with at least two semi-circular openings 12*f* cut therein, wherein the semi-circular openings 12*f* are sized and shaped to allow an umbrella shaft 14*b* to slide therein and secure in place. Additionally, the semi-circular openings 12*f* may be lined with a rubber material designed to allow both 8 and 10 mm umbrella shafts 14*b* to securely fit therein. Moreover, the openings 12*f* may include upward corners to reduce accidental removal of the umbrella shaft 14*b* from the device 10 during use. The semi-circular openings 12*f* may also act as a placement for hanging a strap extending from the umbrella 14 during non-use, leading to an all-day hands-free experience. The user 16 may move the device 12 upward or downward until the center portion 12*b* is at a preferred location on the front shoulder relative to the positioning of the umbrella 14.

The second end of the center portion 12*b* may be attached to or transition into the bottom portion 12*c* of the strap body, wherein the bottom portion 12*c* is designed to wrap around the user 16 from the underarm to the back. The bottom portion 12*c* may begin proximate to the middle portion 12*b* with an outward curve, as shown in FIG. 3, to allow the underarm to grab it, if needed, and may then gradually flex toward the back to contour to any human body size. The user 16 may position the bottom portion 12*c* upward or downward until it feels secure and comfortable under the armpit and back. An end of the bottom portion 12*c* distal from the middle portion 12*b* may comprise a fastening structure for removably engaged with the securing strap. For example, the end of the bottom portion 12*c* distal from the middle portion 12*b* may have a structure similar to the end of the top portion 12*a* distal from the middle portion 12*b* and, thus, may comprise an orifice, such as a circular orifice 12*h*, extending therethrough. While the holder assembly 12 may be made of any desired materials, in some embodiments an outer shell 12*d* thereof may comprise a polypropylene material with various thickness and flexibility, while an inner lining 12*e* (i.e., the surface positioned toward the user 16 during use) may comprise a non-slip thermoplastic elastomer material that also surrounds the semi-circular openings 12*f*. The non-slip rubbery lining 12*e* may provide improved comfort and may help secure the shaft 14*b* in the semi-circular openings 12*f* by having a special texture, angles, and shape, while the flexible plastic outer shell 12*d* may be designed to grab the user's shoulder and upper back securely.

As shown in the Figures, the securing strap 18, 22 may comprise an elongate strap designed to removably engage with the holder assembly 12. For example, the securing strap 18, 22 may comprise a hook and loop material 20. In a particular embodiment, and as shown in FIGS. 5 and 6, the securing strap may comprise a central loop material 20*b* and each end of the strap may comprise a hook section 20*a*. The hook and/or loop material may be double sided, such that the securing strap may be easily and quickly used. While a hook and loop fastener is envisioned, the use of other elongate straps with alternative fasteners are envisioned. For example, the elongate straps may include clips, snaps, buttons, or the like. Additionally, while the securing strap may comprise any desired material, in some embodiments, the securing strap comprises an elastic or stretchable material.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. An adjustable and wearable device for hands-free carrying of an umbrella comprising an umbrella shaft and an umbrella canopy extending from the umbrella shaft, the device comprising:

a holder assembly designed to partially surround, grab, and contour to a user's upper torso, the holder assembly comprising a curved and contoured elongate strap body having a first end and a second end, wherein strap body includes at least two openings each comprising a curved entrance into a semi-circular area sized to accommodate the umbrella shaft, wherein the portion of the elongate strap body between two of the openings is configured to extend around one side of the umbrella and the portions of the elongate strap body near each of the two openings and opposite the other of the two openings are configured to extend around the other side of the umbrella to secure the umbrella in the openings; and a securing strap removably engaged with the first end and the second end of the strap body.

2. The device of claim 1, wherein:

the elongate strap body comprises a top portion, a center portion, and a bottom portion;

the top portion and the bottom portion comprise a free top end and a free bottom end, respectively, wherein the free top end and the free bottom end each comprise a fastening structure for removably engaging with the securing strap; and the at least two semi-circular and curvy openings extend through the center portion.

3. The device of claim 2, wherein the top portion comprises a flexible material configured to contour to the user's shoulder.

4. The device of claim 2, wherein the center portion comprises a middle rigid section with the at least two semi-circular openings cut therein.

5. The device of claim 4, wherein the at least two semi-circular openings each comprise upward corners.

6. The device of claim 2, wherein each fastening structure comprises a circular orifice extending through the free top end and the free bottom end, respectively.

7. The device of claim 1, wherein an inner surface of the holder assembly comprises a non-slip lining.

8. The device of claim 1, wherein an interior and surrounding surface of the semi-circular openings comprises a non-slip lining.

9. The device of claim 1, wherein the securing strap comprises a hook and double-sided loop material.

10. The device of claim 9, wherein the securing strap comprises a central loop material and hook sections positioned at each end thereof.

* * * * *